US009781796B1

(12) United States Patent
Loomis et al.

(10) Patent No.: US 9,781,796 B1
(45) Date of Patent: Oct. 3, 2017

(54) BRIGHTNESS CONTROL SYSTEM FOR DECORATIVE LIGHT STRINGS

(71) Applicant: Seasons 4, Inc., Toano, VA (US)

(72) Inventors: Jason Loomis, Decatur, GA (US); Fred Schleifer, Spencer, NY (US); Nash Rittmann, Odessa, FL (US)

(73) Assignee: Seasons 4, Inc., Toano, VA (US)

( * ) Notice: Subject to any disclaimer, the term of this patent is extended or adjusted under 35 U.S.C. 154(b) by 0 days.

(21) Appl. No.: 15/087,064

(22) Filed: Mar. 31, 2016

(51) Int. Cl.
*H05B 37/00* (2006.01)
*H05B 33/08* (2006.01)
*H05B 37/02* (2006.01)

(52) U.S. Cl.
CPC ..... *H05B 33/0851* (2013.01); *H05B 33/0815* (2013.01); *H05B 33/0842* (2013.01); *H05B 33/0857* (2013.01); *H05B 37/029* (2013.01); *H05B 37/0227* (2013.01); *H05B 37/0245* (2013.01); *H05B 37/0272* (2013.01)

(58) Field of Classification Search
CPC ..... H05B 33/0815; H05B 33/0842; H05B 33/0857; H05B 37/029; H05B 37/0227; H05B 37/0245; H05B 37/0272
USPC ..... 315/185 R, 192, 193, 294, 312
See application file for complete search history.

(56) References Cited

U.S. PATENT DOCUMENTS 6,150,802 A 11/2000 Andrews
7,852,011 B2 * 12/2010 Peng ..... H05B 33/0803 315/185 R
8,007,129 B2 * 8/2011 Yang ..... H05B 33/0803 315/185 S
2005/0068459 A1 3/2005 Holmes et al.
2009/0045941 A1 2/2009 Cooper
2011/0254462 A1 10/2011 Ruan et al.
2011/0285299 A1 * 11/2011 Kinderman ..... H05B 37/029 315/192

(Continued)

FOREIGN PATENT DOCUMENTS

DE 102006026938 A1 12/2007
EP 2337207 A2 6/2011
GB 2490887 A 11/2012

OTHER PUBLICATIONS

Extended European Search Report, for European Patent Application No. 17164189.7, dated Aug. 8, 2017, 7 pages.

*Primary Examiner* — Tung X Le
(74) *Attorney, Agent, or Firm* — Kinney & Lange, P.A.

(57) ABSTRACT

Apparatus and associated methods relate to providing a constant-brightness lighting power to one or more interconnected light strings. A light string power controller draws operating power from a power source that has a variable voltage. The light string power controller supplies constant-brightness lighting power to the one or more interconnected light strings connected to a light-string connector. The constant brightness operating power is both independent of the variable voltage of the power source and independent of a number, up to a predetermined maximum number, of the one or more interconnected light strings connected to the light-string connector. Additional light strings can be connected to the one or more interconnected light strings without affecting a brightness of the one or more interconnected light strings. The brightness of the one or more interconnected light strings is similarly unaffected by voltage variations of the power source.

20 Claims, 4 Drawing Sheets

(56) References Cited

U.S. PATENT DOCUMENTS

| | | | | |
|---|---|---|---|---|
| 2012/0229032 | A1* | 9/2012 | Van De Ven | H05B 33/086 315/151 |
| 2013/0063042 | A1* | 3/2013 | Bora | H05B 33/0863 315/292 |
| 2015/0102731 | A1* | 4/2015 | Altamura | H05B 33/0821 315/152 |
| 2017/0053604 | A1* | 2/2017 | Li | H04M 1/725 |

* cited by examiner

BRIGHTNESS CONTROL SYSTEM FOR DECORATIVE LIGHT STRINGS

BACKGROUND

Decorative light strings are used to communicate a joy of a holiday season, to draw attention to merchandise, or to simply decorate or adorn an object. Decorative light strings have been used to adorn trees, shrubs, and houses. Decorative light strings are used both indoors and outdoors. In some lighting situations, power sources for such decorative light strings are difficult to tap or unavailable altogether. In such lighting situations, batteries can be used to provide power to light strings and to other decorative lights.

Batteries, however, may have a power supply capability that changes in response to changes in battery charge, ambient temperature, number of charge cycles, etc. When used to provide lighting power to decorative light strings, variations in the power supply capability of batteries can be manifest by variations in brightness of the decorative light strings. For example, the brightness of the decorative light string may decrease in response to charge depletion of the battery over time. The decorative light string may thus become less decorative over time.

SUMMARY

Apparatus and associated methods relate a constant-brightness lighting system including a light string having a plurality of LEDs distributed along a length of the light string. The constant-brightness lighting system also includes a light-string controller connected to a first end of the light string. The light-string controller includes a battery compartment configured to receive one or more batteries. The one or more batteries are configured to provide a battery voltage that varies in response to one or more battery conditions. The light-string controller includes a load sensor configured to sense a signal indicative of a brightness of the light string connected to the light-string controller. The light-string controller also includes a switching supply configured to draw operating power from the one or more batteries received by the battery compartment and to supply lighting power to the light string connected to the light-string controller. The switching supply supplies lighting power such that the sensed signal indicative of the brightness is within plus or minus 10% of a target signal indicative of a target brightness. The target signal is a constant and independent of the battery voltage.

In some embodiments, a modular constant-brightness lighting system includes a battery-module connector configured to electrically connect to one or more interconnected battery modules. The one or more interconnected battery modules are configured to provide a battery-module voltage that varies in response to one or more battery conditions. The modular constant-brightness lighting system includes a light-string connector configured to connect to one or more interconnected light strings. The modular constant-brightness lighting system includes a load sensor configured to sense a signal indicative of a brightness of the one or more interconnected light strings connected to the light-string connector. The modular constant-brightness lighting system also includes a switching supply configured to draw operating power from the one or more interconnected battery modules connected to the battery-module connector and to supply lighting power to the one or more interconnected light strings connected to the light-string connector. The supplied lighting power results in the sensed signal indicative of the brightness being within plus or minus 10% of a target signal indicative of a target brightness. The target signal is independent of the battery-module voltage.

Some embodiments relate to a method of controlling a constant brightness in a light string. The method includes providing one or more batteries. The one or more batteries are configured to provide a battery voltage that varies in response to one or more battery conditions. The method includes drawing operating power from the one or more batteries. The method includes providing a light string having a plurality of LEDs distributed along a length of the light string. The method includes supplying lighting power to the provided light string. The method includes sensing a signal indicative of a brightness of the provided light string. The method includes comparing the sensed signal indicative of the brightness to a target signal indicative of a target brightness. The method also includes adjusting the supplied lighting power based on the comparison of the sensed signal indicative of the brightness to the target signal indicative of the target brightness. The adjusted supplied lighting power results in the sensed signal indicative of the brightness being within plus or minus 10% of the target signal indicative of the target brightness. The target signal is independent of the battery voltage.

DETAILED DESCRIPTION

Figure 1:
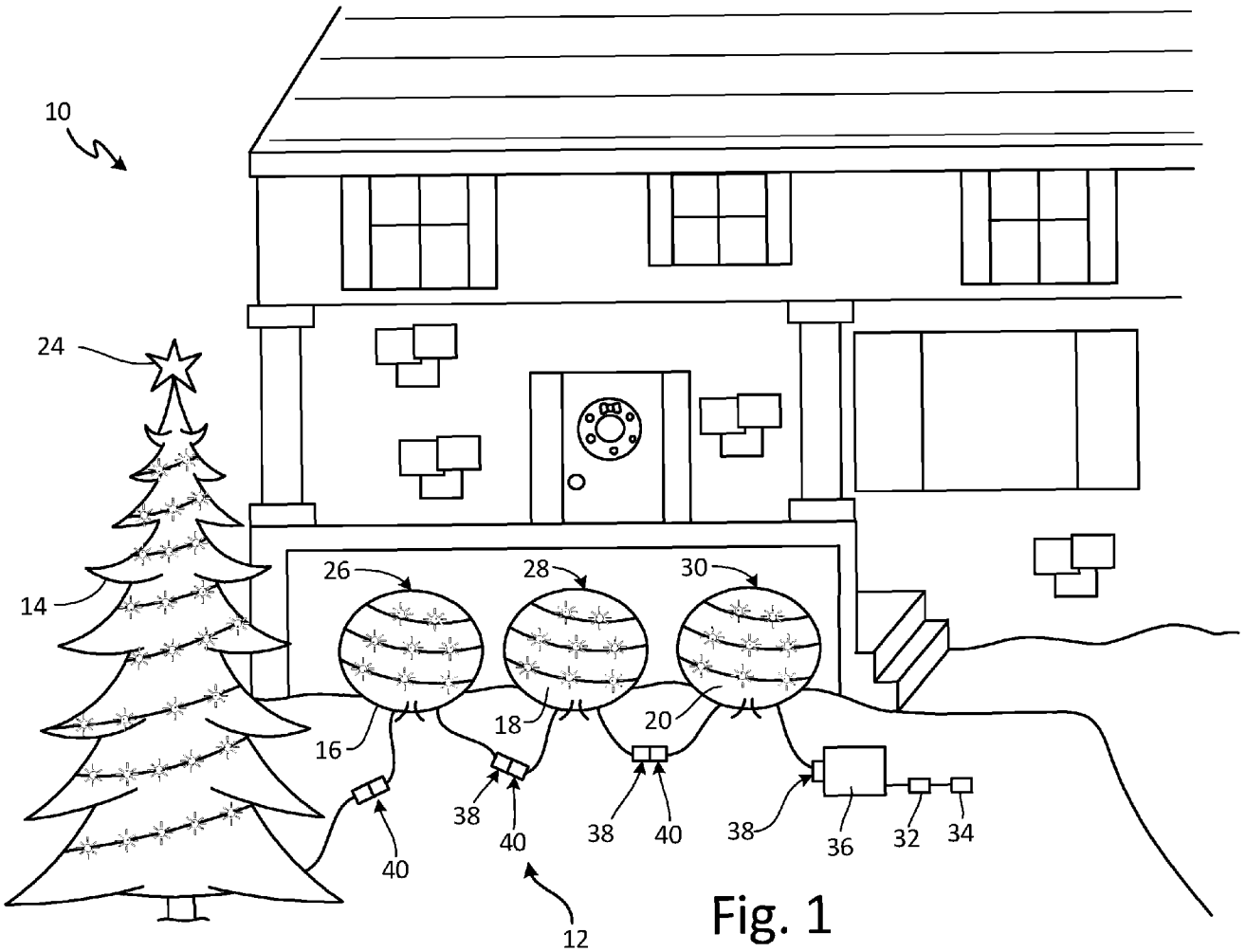
FIG. 1 is a schematic view of a home decorated with various decorative light strings controlled by an exemplary lighting controller providing for constant brightness.

FIG. 1 is a schematic view of a home decorated with various decorative light strings controlled by an exemplary lighting controller providing for constant brightness. In FIG. 1, home 10 has garden 12 with tree 14 and shrubs 16, 18, 20. Tree 14 is decorated with decorative light string 22 and decorative illuminated star 24. Shrubs 16, 18, 20 are decorated with decorative light strings 26, 28, 30, respectively. Battery modules 32, 34 are interconnected with each other, and battery modules 32, 34 are coupled to lighting controller 36. Decorative light strings 22, 26, 28, 30 and decorative illuminated star 24 are interconnected with one another, and interconnected decorative light strings 22, 26, 28, 30 and decorative illuminated star 24 are coupled to lighting controller 36.

Lighting controller 36 may have an internal power source, but can also draw operating power from battery modules 32, 34 coupled to lighting controller 36. Lighting controller 36 can provide constant-brightness lighting power to interconnected decorative light strings 22, 26, 28, 30 and decorative illuminated star 24. Each of interconnected decorative light strings 26, 28, 30 is depicted as having first light-string connector 38 and second light-string connector 40 on opposite ends of light strings 26, 28, 30. First light-string connectors 38, second light-string connector 40 or both first and second light-string connectors 38, 40 may have additional connection ports to which additional light strings or other decorative lighting elements can be connected.

If additional decorative lighting elements are connected to interconnected decorative light strings 22, 26, 28, 30 and decorative illuminated star 24, then lighting controller 36 adaptively provides additional power to the interconnected decorative light strings 22, 26, 28, 30 and decorative illuminated star 24 having such additional decorative lighting elements. Lighting controller 36 can sense a power drawn by interconnected decorative light strings 22, 26, 28, 30 and decorative illuminated star 24 having such additional decorative lighting elements. Lighting controller 36 can then source additional power to interconnected decorative light strings 22, 26, 28, 30 and decorative illuminated star 24 having such additional decorative lighting elements.

The amount of additional power sourced by lighting controller 36 is sufficient to maintain a constant brightness of interconnected decorative light strings 22, 26, 28, 30 and decorative illuminated star 24. In other words, the power level provides by lighting controller 36 to light strings 22, 26, 28, 30 and decorative illuminated star 34 is maintained even though additional lighting elements are added. This maintained power level to light strings 22, 26, 28, 30 and decorative illuminated star 34 is achieved by lighting controller 36 sourcing additional lighting power.

Figure 2:
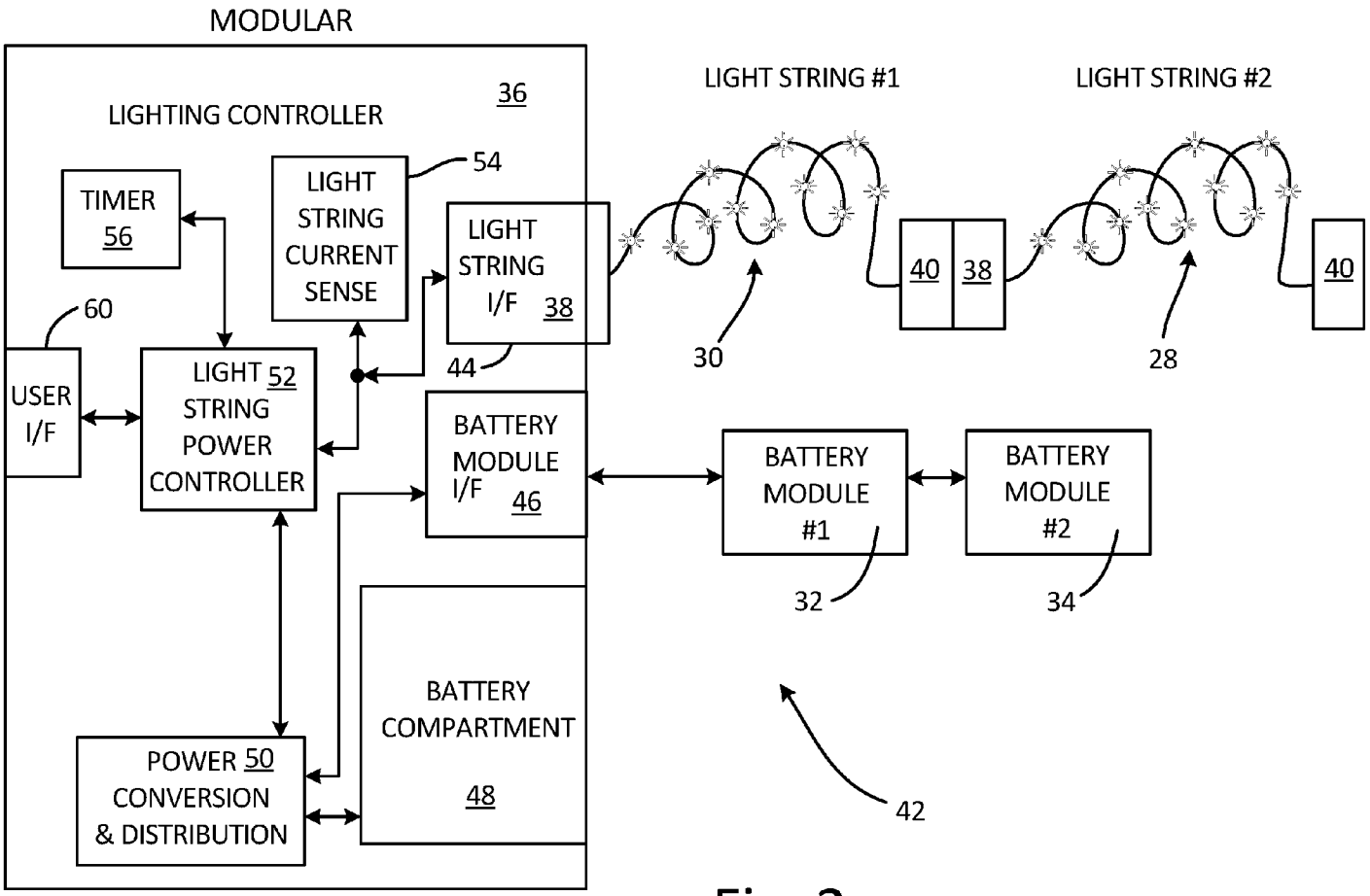
FIG. 2 is a block diagram of an exemplary modular lighting system.

FIG. 2 is a block diagram of an exemplary modular lighting system. In FIG. 2 modular lighting system 42 include lighting controller 36, first light-string 30, second light string 28, first battery module 32, and second battery module 34. First and second light strings 30, 28 are interconnected one to another. First and second light string 30, 28 each has first light-string connector 38 and second light-string connector 40. Second light-string connector 40 of first light string 30 is electrically connected to first light-string connector 38 of second light string 28.

First and second battery modules 32, 34 are interconnected to one another in a similar manner to the manner in which first and second light strings 30, 28 are interconnected to one another. In some embodiments, battery modules 32, 34 can be interconnected in a serial fashion. In some embodiments, battery modules 32, 34 can be interconnected in a parallel fashion. In some embodiments, battery modules 32, 34 can be interconnected in a daisy-chain fashion.

Lighting controller 36 includes: light string interface 44; battery module interface 46, battery compartment 48; power conversion and distribution module 50; light string power controller 52; light string current sense module 54; timer 56; and user interface 60. Interconnected first and second light strings 30, 28 are connected to lighting controller 36 via light string interface 44 and first light-string connector 38 of first light string 30. Interconnected first and second battery modules 32, 34 are connected to lighting controller 36 via battery module interface 46.

Battery compartment 48 can receive one or more batteries. Power conversion and distribution module 50 receives power from interconnected first and second battery modules 32, 34 or from battery compartment 48 or from both interconnected first and second battery modules 32, 34 and battery compartment 48. Power distribution and control module 50 then generates one or more supply levels for use by various components of lighting controller 36.

Light string power controller 52 receives operating power from power conversion and distribution module 50. Light string power controller 52 provides constant-brightness lighting power to interconnected first and second light strings 30, 28 via light string interface 44. The constant-brightness lighting power is substantially independent of a first voltage that varies with a charge of a battery received in battery compartment 48, and independent of a second voltage that varies with a charge of first and second battery modules 32, 34, and independent of a number (e.g., two in the depicted embodiment), up to a predetermined maximum number, of interconnected light strings connected to the light-string connector. In some embodiments, the predetermined maximum number of interconnected light strings to which lighting module 36 can supply constant-brightness lighting power is constrained by a maximum power rating of light string power controller 52. In various embodiments the maximum power rating of light string power controller 52 is capable of providing illuminative power to 2, 3, 5, 8 or 10 light strings.

Constant-brightness lighting power is defined to mean lighting power that is within a limited range of predetermined power level. For example, constant-brightness lighting power can mean a lighting power within plus or minus 15%, 10%, 6%, or about 3% of a target lighting power, for example. In some embodiments, constant-brightness lighting power can mean lighting voltage within plus or minus 12%, 10%, 5%, or about 3% of a target lighting voltage, for example.

Light string current sensor 54 can sense a current drawn by interconnected first and second light strings 30, 28. Light string current sensor can then generate a signal indicative of the sensed current drawn by interconnected first and second light strings 30, 28. Light string current sensor can then output the generated signal indicative of the sensed current drawn by interconnected first and second light strings 30, 28 to light string power controller 52. Light string power controller 52 can then change, if necessary, a lighting power so as to maintain the constant-brightness lighting power provided to the first and second light strings 30, 28.

Such adaptive control of lighting power can maintain constant brightness of first and second light strings 30, 28 even should some LEDs of first and second light strings fail. Such adaptive control of lighting power can maintain constant brightness of first and second light strings 30, 28 even should additional light strings be added. Such adaptive control of lighting power can maintain constant brightness of first and second light strings 30, 28 even should one of first and second light strings 30, 28 be removed.

Adaptive control of lighting power has other advantages. For example, adaptive control of lighting power can maintain a constant brightness of light strings 30, 28 through changes in an ambient temperature. For example, a current-voltage relation in a light string can change in response to a changing ambient temperature. If the current-voltage relation of a light string changes, open loop power control can result in non-constant brightness of the light string. But by sensing both a current drawn by the light string and a voltage across the light string, a power can be measured. In some embodiments, the power can then be adaptively controlled to maintain constant brightness in the light string.

Timer 56 can generate timing signals and provide such timing signals to light string power controller 52. Light string power controller 52 can respond to such timing signals, for example, by turning on first and second light strings 30, 28, turning off first and second light strings 30, 28, dimming first and second light strings 30, 28, etc. Such timing signals may be used to change colors of first and second light strings 30, 28, for example. In some embodiments, such timing signals may be used to make first and second light strings 30, 28 flash on and off in some predetermined fashion. Timer 56 may generate a command signal indicative of a specific lighting command and/or function.

User interface 60 may include user output devices and/or user input devices. Examples of output devices can include a display device, a sound card, a video graphics card, a speaker, a cathode ray tube (CRT) monitor, a liquid crystal display (LCD), a light emitting diode (LED) display, an organic light emitting diode (OLED) display, or other type of device for outputting information in a form understandable to users or machines. Examples of input device(s) 48 can include a mouse, a keyboard, a microphone, a camera device, a presence-sensitive and/or touch-sensitive display, or other type of device configured to receive input from a user.

In some embodiments, user interface 60 may be in a form of a communications port. User interface 60, in one example, utilizes one or more communication devices to communicate with external devices via one or more networks, such as one or more wireless or wired networks or both. User interface 60 can be a network interface card, such as an Ethernet card, an optical transceiver, a radio frequency transceiver, or any other type of device that can send and receive information. Other examples of such network interfaces can include Bluetooth, 3G, 4G, and WiFi radio computing devices as well as Universal Serial Bus (USB).

Figure 3:
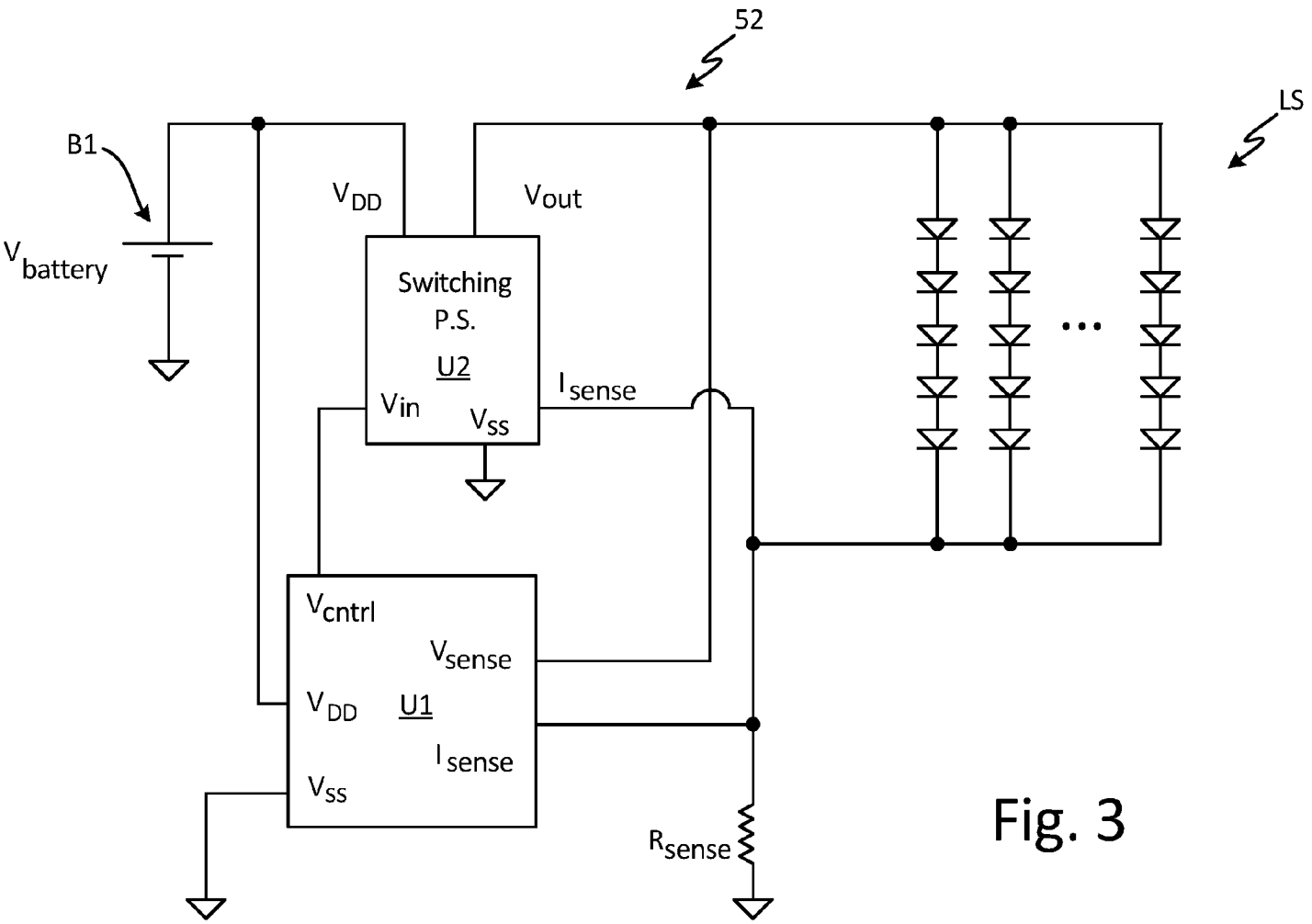
FIG. 3 is a circuit schematic diagram of an exemplary constant-brightness decorative lighting system.

FIG. 3 is a circuit schematic diagram of an exemplary constant-brightness decorative lighting system. In FIG. 3, light string power controller 52 includes battery B1, LED lighting controller U1, switching power supply U2, current sense resistor $R_{SENSE}$, and light string LS. Output $V_{OUT}$ of switching power supply U2 provides operating power to light string LS. Output $V_{OUT}$ of switching power supply U2 is also coupled to node $V_{SENSE}$ of LED lighting controller U1. A voltage across current sensing resistor $R_{SENSE}$ is indicative of the current through light string LS. The voltage across $R_{SENSE}$ is provided to node $I_{SENSE}$ of LED lighting controller U1 and node $I_{SENSE}$ of switching power supply U2. In some embodiments, switching power supply U2 uses the $I_{SENSE}$ signal for fast, closed-loop control of the LED current. In some embodiments, lighting controller U1 uses the signal for fine-tuning of the LED current and/or to detect low-battery charge conditions.

LED lighting controller U1 generates control signal $V_{CTRL}$, based on the signals received on nodes $V_{SENSE}$ and/or $I_{SENSE}$. The generated control signal $V_{CTRL}$ is then output to input pin $V_{IN}$ of switching power supply U2. Control signal $V_{CTRL}$ is indicative of a desired lighting power. Switching power supply U2 receives the control signal $V_{CTRL}$ indicative of the desired lighting power on node $V_{IN}$. Switching power supply U2 generates a constant-brightness lighting power and supplies the constant-brightness lighting power to light string LS via output node $V_{OUT}$. Both switching power supply U2 and LED lighting controller U1 receive operating power from battery B1.

Various embodiments can use various means for providing constant-brightness lighting power to an interconnected number of light strings. In some embodiments, light string power controller 52 can generate and provide constant-brightness lighting power. In some embodiments, light string power controller 52 can include any one or more of a microprocessor, a controller, a digital signal processor (DSP), an application specific integrated circuit (ASIC), a field-programmable gate array (FPGA), or other equivalent discrete or integrated logic circuitry. In some embodiments, light string power controller 52 may generate a digital signal indicative of a constant-brightness lighting power. A digital-to-analog converter can then convert the digital signal indicative of the constant-brightness lighting power to an analog power signal supplying the constant-brightness lighting power.

Figure 4:
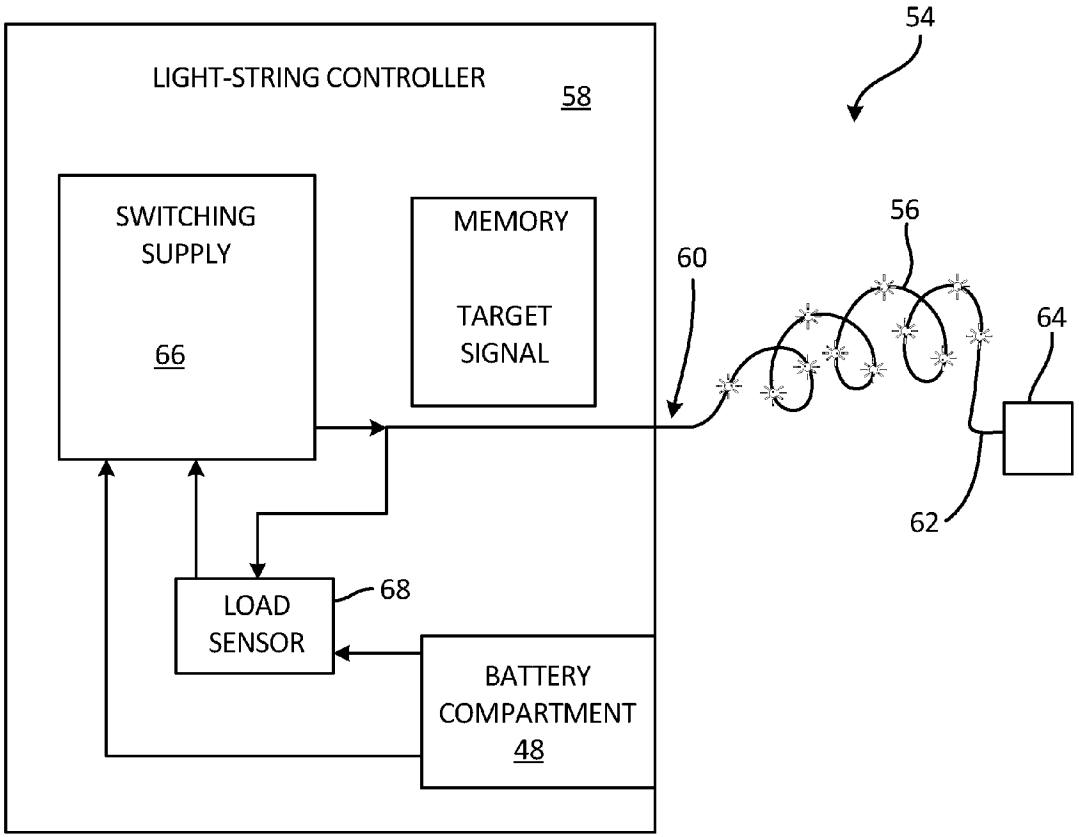
FIG. 4 is a block diagram of an exemplary constant-brightness decorative lighting system.

FIG. 4 is a block diagram of an exemplary constant-brightness lighting system. The constant-brightness lighting system depicted in FIG. 4 is a simplified version compared with the modular lighting system depicted in FIG. 2. In FIG. 4, constant-brightness lighting system 54 includes light string 56 and light-string controller 58. Light string 56 is connected to light-string controller 58 at first end 60 of light string 56. At second end 62 of light string 56 is light string connector 64. Light string connector 64 is configured to connect to additional interconnected lighting elements.

Light-string controller 58 has battery compartment configured to receive one or more batteries. The received batteries can provide operating power to light-string controller 58 which provides a portion of such operating power to light string 56 in the form of lighting power. Light-string controller 58 includes switching supply 66, load sensor 68, and memory module 70. Switching supply 66 and load sensor 68 are in electrical communication with light string 56. Load sensor 68 is configured to sense a signal indicative of a brightness of light string 56. Load sensor 68 may provide the sensed signal indicative of the brightness of light string 56 to switching supply 66. In some embodiments, load sensor 68 can generate a new signal indicative of the brightness of light string 56 and provide the generated new signal to switching supply 66. For example, load sensor may amplify and/or filter the sensed signal before providing the generated new signal to switching supply 66.

Switching supply 66 can compare the received signal indicative of the brightness with a target signal 72. Target signal 72 can be retrieved from memory 58 and/or it can be calculated by switching supply 66. In some embodiments, target signal 72 can be calculated based on the received signal indicative of the lighting brightness. For example, the signal indicative of the lighting brightness may include a signal indicative of a number of lighting elements. The target brightness may be calculated to vary in response to the number of lighting elements, for example. For example, a sensed voltage can be indicative of a lighting brightness, and a sensed current can be indicative of a number of lighting elements.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A constant-brightness lighting system comprising:

a light string having a plurality of LEDs distributed along a length of the light string; and a light-string controller connected to a first end of the light string, wherein the light-string controller includes:

a battery compartment configured to receive one or more batteries, the one or more batteries configured to provide a battery voltage that varies in response to one or more battery conditions;

a load sensor configured to sense a signal indicative of a brightness of the light string connected to the light-string controller; and a switching supply configured to draw operating power from the one or more batteries received by the battery compartment and to supply lighting power to the light string connected to the light-string controller, wherein the switching supply adjusts the supplied lighting power such that the sensed signal indicative of the brightness is within plus or minus 10% of a target signal indicative of a target brightness, the target signal being independent of the battery voltage.

2. The constant-brightness lighting system of claim 1, wherein the one or more battery conditions in response to which the battery voltage varies comprises a battery charge.

3. The constant-brightness lighting system of claim 1, wherein the one or more battery conditions in response to which the batter voltage varies comprises a battery load.

4. The constant-brightness lighting system of claim 1, wherein the one or more battery conditions in response to which the battery voltage varies comprises a battery temperature.

5. The constant-brightness lighting system of claim 1, further comprising a light-string connector at a second end of the light string, the light string connector configured to provide electrical connection to one or more interconnected decorative lighting elements.

6. The constant-brightness lighting system of claim 1, wherein the sensed signal indicative of the brightness of the light string connected to the light-string controller comprises an electrical voltage.

7. The constant-brightness lighting system of claim 1, wherein the sensed signal indicative of the brightness of the light string connected to the light-string controller comprises an electrical current.

8. The constant-brightness lighting system of claim 1, wherein the sensed signal indicative of the brightness of the light string connected to the light-string controller comprises a light intensity.

9. The constant-brightness lighting system of claim 1, wherein the target signal indicative of the target brightness is a constant voltage signal.

10. The constant-brightness lighting system of claim 1, wherein the plurality of LEDs is electrically configured as a parallel connection of substrings, each substring having a plurality of series connected of LEDs.

11. A modular constant-brightness lighting system comprising:

a battery-module connector configured to electrically connect to one or more interconnected battery modules, the one or more interconnected battery modules configured to provide a battery-module voltage that varies in response to one or more battery conditions;

a light-string connector configured to connect to one or more interconnected light strings;

a load sensor configured to sense a signal indicative of a brightness of the one or more interconnected light strings connected to the light-string connector; and a switching supply configured to draw operating power from the one or more interconnected battery modules connected to the battery-module connector and to supply lighting power to the one or more interconnected light strings connected to the light-string connector, wherein the switching supply adjusts the supplied lighting power such that the sensed signal indicative of the brightness is within plus or minus 10% of a target signal indicative of a target brightness, the target signal being a constant and independent of the battery voltage.

12. The modular constant-brightness lighting system of claim 11, further comprising:

one or more interconnected battery modules, each of the one or more interconnected battery modules configured to hold a battery, each of the one or more interconnected battery modules including:

a first power connector configured to provide operating power having a variable voltage; and a second power connector configured to receive operating power having a variable voltage.

13. The modular constant-brightness lighting system of claim 11, further comprising:

one or more interconnected light strings, each of the one or more interconnected light strings including:

a first connector at a first end of the light string; and a second connector at the second end of the light string, wherein the first connector is configured to receive a first portion of the supplied lighting power, and the second connector is configured to supply a second portion of the received first portion of the supplied lighting power.

14. The modular constant-brightness lighting system of claim 11, wherein each of the one or more interconnected light strings further includes:

a plurality of parallel connected substrings, each substring having a plurality of series connected of LEDs.

15. The modular constant-brightness lighting system of claim 11, further comprising:

a timer configured to provide a timing signal, wherein, if the timing signal is in a first state, then the switching supply supplies lighting power to the one or more interconnected light strings connected to the light-string connector, and wherein, if the timing signal is in a second state, the switching supply provides no lighting power to the one or more interconnected light strings connected to the light-string connector.

16. The modular constant-brightness lighting system of claim 11, further comprising:

a communications interface configured to receive lighting signal commands from a remote controller.

17. The modular constant-brightness lighting system of claim 11, further comprising:

a user interface configured to receive lighting signal commands from a user.

18. A method of controlling a constant brightness in a light string, the method comprising the steps of:

providing one or more batteries, the one or more batteries configured to provide a battery voltage that varies in response to one or more battery conditions;

drawing operating power from the one or more batteries;

providing a light string having a plurality of LEDs distributed along a length of the light string;

supplying lighting power to the provided light string;

sensing a signal indicative of a brightness of the provided light string;

comparing the sensed signal indicative of the brightness to a target signal indicative of a target brightness; and adjusting the supplied lighting power based on the comparison of the sensed signal indicative of the brightness to the target signal indicative of the target brightness, wherein the adjusted supplied lighting power results in the sensed signal indicative of the brightness being within plus or minus 10% of the target signal indicative of the target brightness, the target signal being independent of the battery voltage.

19. The method of claim 18 wherein sensing a signal indicative of a brightness of the provided light string comprises:

sensing an electrical voltage across a voltage sampling element.

20. The method of claim 18 wherein sensing a signal indicative of a brightness of the provided light string comprises:

sensing a light intensity emitted from a LED sampling element.

* * * * *